US006101437A

United States Patent [19]

Oshina et al.

[11] Patent Number: 6,101,437

[45] Date of Patent: Aug. 8, 2000

[54] OPERATION CONTROL DEVICE FOR THREE-JOINT EXCAVATOR

[76] Inventors: Morio Oshina, 2673-89; Mitsuo Sonoda, 3249-16, both of Shimoinayoshi, Chiyodamachi, Niihara-gun, Ibaraki-ken; Eiji Egawa, 709-58, Itaya 4-chome, Tsuchiura-shi, Ibaraki-ken; Junji Tsumura, 4-1, Inayoshiminami 2-chome, Chiyodamachi, Niihara-gun, Ibaraki-ken, all of Japan

[21] Appl. No.: 09/051,874

[22] PCT Filed: Aug. 7, 1997

[86] PCT No.: PCT/JP97/02757

§ 371 Date: Apr. 14, 1998

§ 102(e) Date: Apr. 14, 1998

[87] PCT Pub. No.: WO98/06909

PCT Pub. Date: Feb. 19, 1998

[30] Foreign Application Priority Data

Aug. 15, 1996 [JP] Japan ..... 8-215808

[51] Int. Cl.[7] ..... G06F 19/00

[52] U.S. Cl. ..... 701/50; 37/348; 414/686

[58] Field of Search ..... 701/50; 37/348, 37/414, 395; 414/686

[56] References Cited

U.S. PATENT DOCUMENTS 5,661,917 9/1997 Marchetta et al. ..... 37/348

5,704,141 1/1998 Miura et al. ..... 37/348

5,735,066 4/1998 Tochizawa et al. ..... 37/348

*Primary Examiner*—William A Cuchlinski, Jr.

*Assistant Examiner*—Arthur D. Donnelly

[57] ABSTRACT

A speed command value X1 for a first arm 3 is decided depending on a lever input amount in the direction c, d. Assuming that the side d corresponding to move-up of the first arm is positive, the side c corresponding to move-down thereof is negative, and a speed command value resulted upon full lever operation and corresponding to a rated speed of the first arm is 1, X1 is given by $-1<X1<1$. A speed command value X3 for a third arm 5 is decided depending on a lever input amount in the direction e, f. Assuming that the side f corresponding to dumping of the third arm is positive, the side e corresponding to crowding thereof is negative, and a speed command value resulted upon full lever operation and corresponding to a rated speed of the third arm is 1, X3 is given by $-1<X3<1$. A speed command value X2 for a second arm 4 is here given by $X2=K1\times X1+K3\times X3$ on condition that the side corresponding to move-up of the second arm is positive. With such an operation control system for a 3-articulation type excavator, the excavator can be operated by operators having an ordinary skill continuously over a wide working area specific to 3-articulation type excavators with the same operating feeling as obtained with conventional 2-articulation type excavators.

11 Claims, 16 Drawing Sheets

OPERATION CONTROL DEVICE FOR THREE-JOINT EXCAVATOR

TECHNICAL FIELD

The present invention relates to an operation control system for an excavator of the 3-articulation type, i.e., having three articulations and arms except for a digging bucket, and more particularly to an operation control system which can utilize advantages of a 3-articulation type excavator by using the same operating means as used in a conventional 2-articulation type excavator.

BACKGROUND ART

The structure of a conventional ordinary excavator is shown in FIG. 14. A working front device 100 is made up of two members, i.e., a boom 101 and an arm 102. A bucket 103 for use in excavation work is provided at a tip end of the working front device 100. Such an excavator is called the 2-articulation type because the bucket 103 serving as a main member to carry out the work is positioned by two rotatable structural elements, i.e., the boom 101 and the arm 102.

Meanwhile, the so-called two-piece boom type excavator has been employed recently. One example of the two-piece boom type excavator is shown in FIG. 15. The two-piece boom type excavator is modified from the ordinary excavator, shown in FIG. 14, in that a boom 101 of a working front device 100A is divided into two parts, i.e., a first boom 104 and a second boom 105. Such a two-piece boom type excavator is called here a 3-articulation type excavator based on the number of articulations which take part in positioning a bucket 103.

The 3-articulation type excavator has an advantage of enabling the work to be easily carried out near an undercarriage of the excavator, which has been difficult for the 2-articulation type excavator. More specifically, although the 2-articulation type excavator can also be operated to take a posture shown in FIG. 14 for bringing the bucket 103 to a position near the undercarriage, the excavation work cannot be performed with the arm 102 positioned so horizontally as illustrated. On the other hand, in the 3-articulation type excavator, the bucket 103 can be brought to a position near the undercarriage with the arm 102 held substantially vertical as shown in FIG. 15, allowing the excavation work to be carried out near the undercarriage. Further, the excavation work in a position away from the undercarriage can be performed up to a farther position than reachable with the 2-articulation type excavator by extending the first boom 104 and the second boom 105 to lie almost straight.

Another advantage of the 3-articulation type excavator is in enabling the excavator to turn with a reduced radius of turn. When the direction of the working front device 100A is changed by turning an upper turning structure 106 for loading dug earth and sand on a dump car or the like, it is difficult for the 2-articulation type excavator to reduce the radius necessary for the turn because the boom 101 has a large overall length. In the 3-articulation type excavator, the radius necessary for the turn can be reduced by raising the first boom 104 to take a substantially vertical posture and making the second boom 105 extend substantially horizontally. This means that the 3-articulation type excavator is more advantageous in carrying out the work in a narrow-space site.

Next, the conventional operating method will be explained. FIG. 16 shows one example of control levers for use in an ordinary 2-articulation type excavator. In normal excavation work, four kinds of operations effected by the boom, the arm, the bucket and the turn are carried out frequently in a combined manner. These four kinds of operations are allocated to two control levers 107, 108 such that each control lever instructs the two kinds of operations. The excavation work is performed by an operator manipulating the respective levers with the left and right hands. As another control lever, there is a (not-shown) travel lever (usually associated with a pedal as well). The travel lever is used independently of the other levers 107, 108 in many cases; hence it is not here taken into consideration.

FIG. 17 shows one example of control levers for use in a 3-articulation type excavator. As mentioned above, the 3-articulation type excavator can be operated to carry out the work over a wide range from a further position to a position nearer to its undercarriage. To realize this, however, the second boom 105 must also be operated in addition to the first boom 104 corresponding to the boom 101 of the 2-articulation type excavator. Since the four kinds of operations are already allocated to the two control levers 107, 108, a seesaw type pedal 109 is newly provided to operate the second boom 105. See FIG. 4 of JP, A, 62-33937, for example.

Further, JP, A, 7-180173 proposes a control system for a 3-articulation type excavator. According to the proposed control system, two control levers are designed to instruct moving speeds of a bucket tip in the X- and Y-directions, respectively, and a predetermined calculation process is executed based on a resultant speed vector signal of those moving speeds. As a result, in horizontal drawing work, movement of the bucket tip can be controlled continuously over a wide range and the bucket can be moved along a desired path with high accuracy.

DISCLOSURE OF THE INVENTION

With the operating system for the 3-articulation type excavator constructed as explained above, a wider working area can be achieved by providing three articulations, but there is a difficulty in continuously operating the working front device over such a wider area. In other words, since the second boom 105 is operated upon the pedal 109 being trod down by the operator's foot, it is difficult to operate the second boom 105 with such fine adjustment as obtainable when operating the lever by the hand, and the second boom 105 cannot be operated in match with the first boom 104, the arm 102 and the bucket 103. Accordingly, as customary fashion followed in most cases, the second boom 105 is fixed in an extended state when carrying out the work in a far position, and is fixed in a contracted state when carrying out the work in a position near the undercarriage.

Further, with the control system proposed in JP, A, 7-180173, the first boom, the second boom, the arm and the bucket of the 3-articulation type excavator can be operated by the two control levers, but these control levers are special ones designed to instruct the moving speeds of the bucket tip in the X- and Y-directions, respectively, and an operating manner of the control levers is much different from that of the ordinary control levers. Therefore, it is hard for operators, who are already familiar with the conventional operating manner, to handle the excavator through the proposed control system.

An object of the present invention is to provide an operation control system for a 3-articulation type excavator which enables operators having an ordinary skill to operate the 3-articulation type excavator continuously over a wide working area specific to 3-articulation type excavators with the same operating feeling as obtained with conventional 2-articulation type excavators.

(1) To achieve the above object, according to the present invention, there is provided an operation control system for a 3-articulation type excavator, the operation control system being installed in a 3-articulation type excavator comprising an excavator body, a first arm rotatably attached to the excavator body, a second arm rotatably attached to the first arm, a third arm rotatably attached to the second arm, a digging bucket rotatably attached to the third arm, and a hydraulic drive circuit including a first arm cylinder for driving the first arm, a second arm cylinder for driving the second arm, a third arm cylinder for driving the third arm, and a bucket cylinder for driving the digging bucket, the operation control system comprising first arm operating means including a first control lever for commanding a speed of the first arm depending on operation of the first control lever, and third arm operating means including a second control lever for commanding a speed of the third arm depending on operation of the second control lever, the first arm cylinder and the third arm cylinder of the hydraulic drive circuit being driven in accordance with respective operation signals from the first arm operating means and the third arm operating means, wherein the operation control system further comprises second arm commanding means for producing a speed command value for the second arm that is calculated from a first value resulted by multiplying a speed command value indicated by the operation signal from the first arm operating means by a first arm assistive gain and a second value resulted by multiplying a speed command value indicated by the operation signal from the third arm operating means by a third arm assistive gain, and output means for converting the speed command value for the second arm into a signal, the second arm cylinder of the hydraulic drive circuit being driven in accordance with the signal from the output means.

While the related art has been described above in connection with, by way of example, the two-piece boom type excavator having a boom divided into two members, a 3-articulation type excavator having an arm divided into two members also has the same functions as the two-piece boom type excavator. Therefore, three members rotatable at their articulations are called a first arm, a second arm and a third arm in this Description for the purpose of more general explanation.

The present invention intends to, as stated above, propose an operation control system for a 3-articulation type excavator which enables operators having an ordinary skill to operate the 3-articulation type excavator continuously over a wide working area specific to 3-articulation type excavators. To realize this, according to the present invention, the 3-articulation type excavator is constructed so that three articulations can be operated by only the same two control levers as used in 2-articulation type excavators.

Specifically, in a 3-articulation type excavator, the operation of moving up a second arm has a substantially equivalent effect to the operation of moving up a first arm with regard to the direction of movement of a bucket, and the operation of moving down the second arm has a substantially equivalent effect to the operation of moving down the first arm with regard to the direction of movement of the bucket. Likewise, the operation of moving up the second arm has a substantially equivalent effect to the operation of dumping (pushing out) a third arm with regard to the direction of movement of the bucket, and the operation of moving down the second arm has a substantially equivalent effect to the operation of crowding (pulling in) the third arm with regard to the direction of movement of a bucket.

The present invention has been made in view of the above point, and the 3-articulation type excavator of the present invention includes control levers (first and second control levers) for only the first arm and the third arm as with conventional 2-articulation type excavators. The second arm is regarded as working to assist the first and third arms, and an input amount for operating the second arm is given by a value calculated based on respective values resulted from multiplying input amounts for operating the first and third arms by respective gains representative of how extent the first and third arms are to be assisted in their operation, for example, the sum of those values.

By so constructing, the bucket can be operated substantially in a like manner as that of a 2-articulation type excavator just by operating the two control levers as with the 2-articulation type excavator, and the second arm is extended and contracted to assist the bucket moving in the direction intended by an operator. Accordingly, the 3-articulation type excavator can be operated continuously over a wide working area specific to 3-articulation type excavators with the same operating feeling as obtained with conventional 2-articulation type excavators.

(2) In the above (1), preferably, the second arm commanding means includes adding means for determining, as a calculated value giving the speed command value for the second arm, the sum of the first value and the second value.

(3) Also in the above (1), preferably, the second arm commanding means includes selecting means for determining, as a calculated value giving the speed command value for the second arm, a maximum value between absolute values of the first value and the second value.

(4) In the above (1), preferably, the operation control system further comprises means for detecting a rotational angle of the first arm relative to the plane on which the excavator body rests, and the second arm commanding means receives a signal from the detecting means and reduces the third arm assistive gain when the first arm comes close to a vertical position relative to the plane on which the excavator body rests.

When the first arm comes close to the vertical position, the second arm acts to operate the bucket vertically contrary to back-and-forth movement of the bucket that is intended by the operator when operating the third arm. In the present invention, therefore, when the first arm comes close to the vertical position, the third arm assistive gain is reduced to make the second arm less moved upon the operation of the third arm. This keeps the operator from feeling awkward.

(5) In the above (1), preferably, the operation control system further comprises means for detecting a rotational angle of the first arm relative to the plane on which the excavator body rests, and the second arm commanding means receives a signal from the detecting means and reduces the first arm assistive gain when the first arm comes close to a horizontal position relative to the plane on which the excavator body rests.

When the first arm comes close to the horizontal position, the second arm acts to operate the bucket back-and-forth contrary to vertical movement of the bucket that is intended by the operator when operating the first arm. In the present invention, therefore, when the first arm comes close to the horizontal position, the first arm assistive gain is reduced to make the second arm less moved upon the operation of the first arm. This keeps the operator from feeling awkward.

(6) Further in the above (1), preferably, the operation control system further comprises means for detecting a rotational angle of the second arm relative to the plane on which the excavator body rests, and the second arm commanding means receives a signal from the detecting means and reduces the third arm assistive gain when the second arm comes close to a horizontal position relative to the plane on which the excavator body rests.

When the second arm comes close to the horizontal position, the second arm acts to operate the bucket vertically contrary to back-and-forth movement of the bucket that is intended by the operator when operating the third arm. In the present invention, therefore, when the second arm comes close to the horizontal position, the third arm assistive gain is reduced to make the second arm less moved upon the operation of the third arm. This keeps the operator from feeling awkward.

(7) In the above (1), preferably, the operation control system further comprises means for detecting a stroke of the first arm cylinder, and the second arm commanding means receives a signal from the detecting means and increases the first arm assistive gain when the first arm cylinder reaches or comes close to the stroke end thereof. In the present invention thus constructed, when the first arm cylinder reaches or comes close to the stroke end thereof, the second arm is sped up to prevent the bucket from being quickly slowed down at the stroke end of the first arm cylinder. As a result, the operator can be kept from feeling awkward.

(8) In the above (1), preferably, the operation control system further comprises means for detecting a stroke of the third arm cylinder, and the second arm commanding means receives a signal from the detecting means and increases the third arm assistive gain when the third arm cylinder reaches or comes close to the stroke end thereof.

In the present invention thus constructed, when the third arm cylinder reaches or comes close to the stroke end thereof, the second arm is sped up to prevent the bucket from being quickly slowed down at the stroke end of the third arm cylinder. As a result, the operator can be kept from feeling awkward.

(9) In the above (1), where the hydraulic drive circuit includes a first flow control valve, a second flow control valve and a third flow control valve for controlling respective flow rates of a hydraulic fluid supplied to the first arm cylinder, the second arm cylinder and the third arm cylinder, preferably, the operation control system further comprises a pilot circuit for introducing respective pilot pressures to the first, second and third flow control valves for operation thereof, the pilot circuit including a pair of pilot lines for introducing the pilot pressures to the second flow control valve for operation thereof, and a pair of proportional pressure reducing valves disposed in the pair of pilot lines and operated by output signals from the output means, respectively.

By thus providing proportional pressure reducing valves in pilot lines and operating the proportional pressure reducing valves, the second arm cylinder can be easily driven by signals from the output means.

(10) In the above (1), where the first arm operating means and the third arm operating means are of the electric lever type outputting electrical signals as the operation signals, preferably, the second arm commanding means receives the electrical signals from the first arm operating means and the third arm operating means, and determines the speed command values from the received electrical signals.

(11) In the above (1), where the first arm operating means and the third arm operating means are of the hydraulic pilot type outputting pilot pressures as the operation signals, preferably, the operation control system further comprises means for detecting the respective pilot pressures from the first arm operating means and the third arm operating means, and the second arm commanding means receives signals from the detecting means and determines the speed command values from the received signals.

BEST MODE FOR CARRYING OUT THE INVENTION

Embodiments of the present invention will be described hereunder with reference to the drawings.

To begin with, a first embodiment of the present invention will be described with reference to FIGS. 1 to 4.

Figure 1:
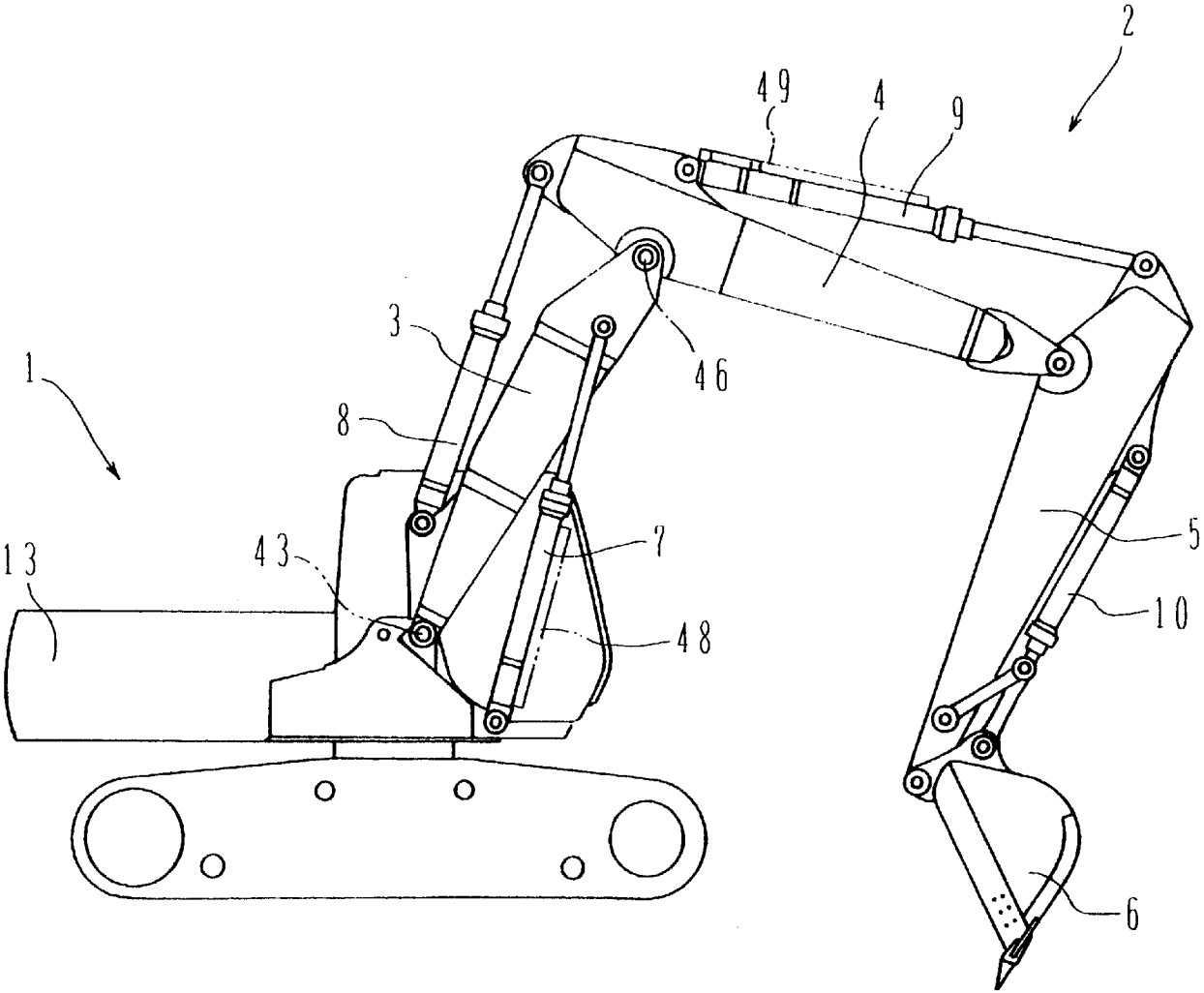
FIG. 1 is a view for explaining the structure of a 3-articulation type excavator to which the present invention is applied.

In FIG. 1, a working front device 2 of an excavator 1 is of the 3-articulation type comprising a first arm 3, a second arm 4 and a third arm 5 which are each attached in a vertically rotatable manner. The working front device 2 has a base end supported by an excavator body 13 (upper turning structure), and a distal end to which a digging bucket 6 is attached in a vertically rotatable manner. The first, second and third arms 3, 4, 5 are driven respectively by first, second and third arm cylinders 7, 8, 9, and the bucket 6 is driven by the bucket cylinder 10.

Figure 2:
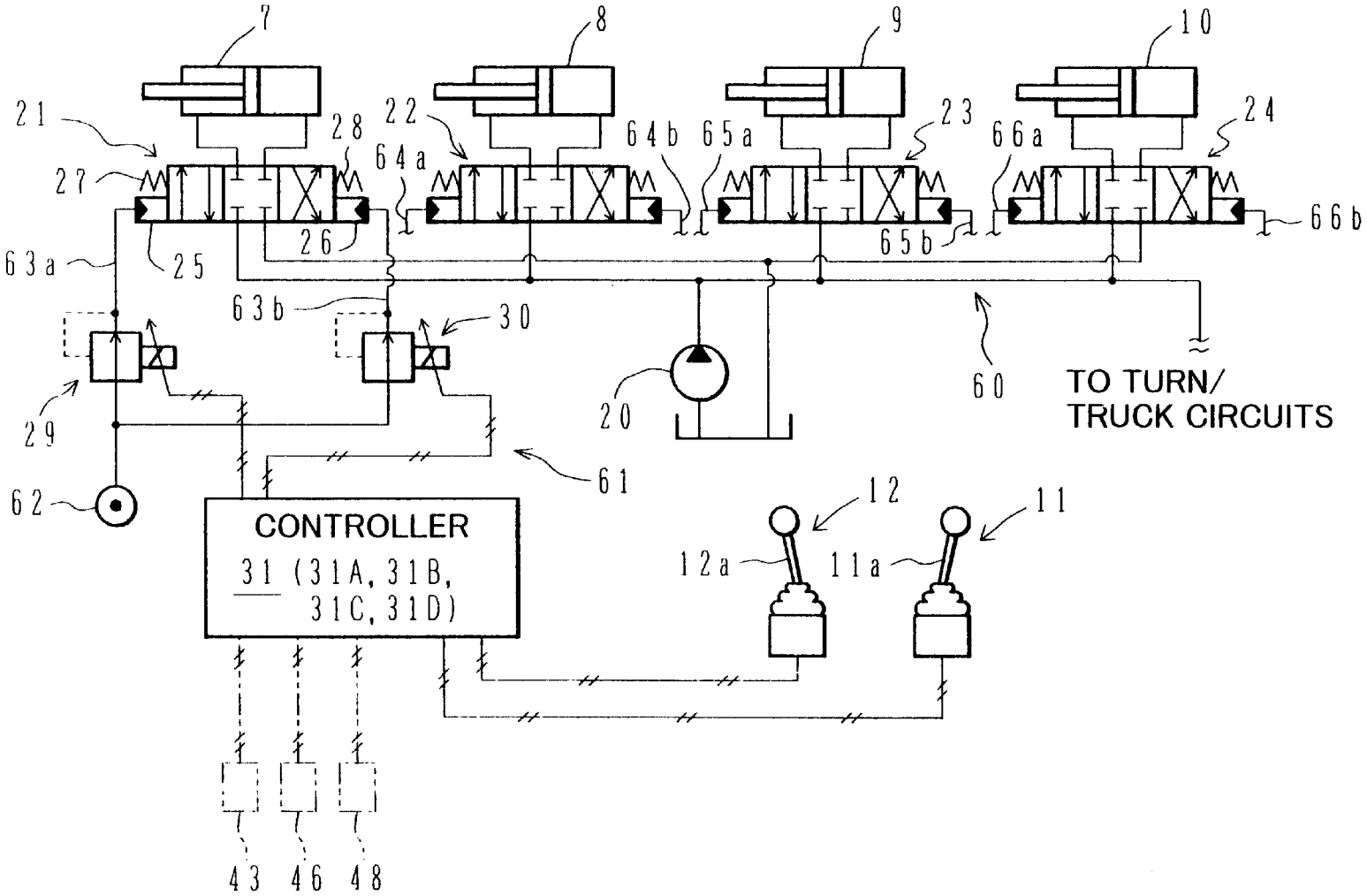
FIG. 2 is a diagram showing the configuration of an operation control system for a 3-articulation type excavator according to one embodiment of the present invention, along with a hydraulic circuit.

FIG. 2 shows one example of a hydraulic circuit. In FIG. 2, denoted by 60 is a hydraulic drive circuit including a first arm cylinder 7, a second arm cylinder 8, a third arm cylinder 9 and a bucket cylinder 10. A working fluid delivered from a hydraulic pump 20 is supplied to the first arm cylinder 7, the second arm cylinder 8, the third arm cylinder 9 and the bucket cylinder 10 through flow control valves 21, 22, 23, 24, respectively. In addition, there are a turn hydraulic motor and a track hydraulic motor, not shown, which are similarly connected to the hydraulic pump 20. Although the following description will be made of the first arm cylinder 7, the other cylinders also operate in a like manner.

Further, denoted by 61 is a pilot circuit for introducing pilot pressures to the flow control valves 21, 22, 23, 24 for operation thereof. The pilot circuit 61 comprises a pilot hydraulic source 62, a pair of pilot lines 63*a*, 63*b* associated with the flow control valve 21 and pairs of similar pilot lines 64*a*, 64*b*; 65*a*, 65*b*, 66*a*, 66*b* (only part of which is shown) associated with the flow control valves 22, 23, 24, and proportional pressure reducing valves 29, 30 disposed respectively in pilot lines 63, 63 and proportional pressure reducing valves (not shown) disposed in pilot lines 64*a*, 64*b*; 65*a*, 65*b*; 66*a*, 66*b*.

In an operative state, the flow control valve 21 is held in a neutral position by being supported by springs 27, 28 and its ports is kept blocked; hence the first arm cylinder 7 is not operated. Pilot pressures adjusted by the proportional pressure reducing valves 29, 30 are introduced to pilot pressure chambers 25, 26 of the flow control valve 21, respectively. When the pilot pressure is established in any of the pilot pressure chambers 25, 26, a valve body of the flow control valve 21 is shifted to a position where a force imposed by the established pilot pressure is balanced by resilient forces of the springs 27, 28. The working fluid is supplied to the first arm cylinder 7 at a flow rate depending on the amount of shift of the valve body, causing the first arm cylinder 7 to extend and contract. The above explanation is equally applied to the flow control valves 22, 23, 24.

The proportional pressure reducing valves 29, 30 and the other not-shown proportional pressure reducing valves are adjusted by respective signals from a controller 31 which in turn receives operation signals from control lever units 11, 12. The control lever units 11, 12 are each of the electric lever type outputting an electrical signal as the operation signal. When control levers 11*a*, 12*a* of the control lever units 11, 12 are operated, the first arm cylinder 7, the second arm cylinder 8, the third arm cylinder 9 and the bucket cylinder 10 can be driven at any desired speeds depending on input amounts by which the control levers 11*a*, 12*a* are operated.

Figure 3:
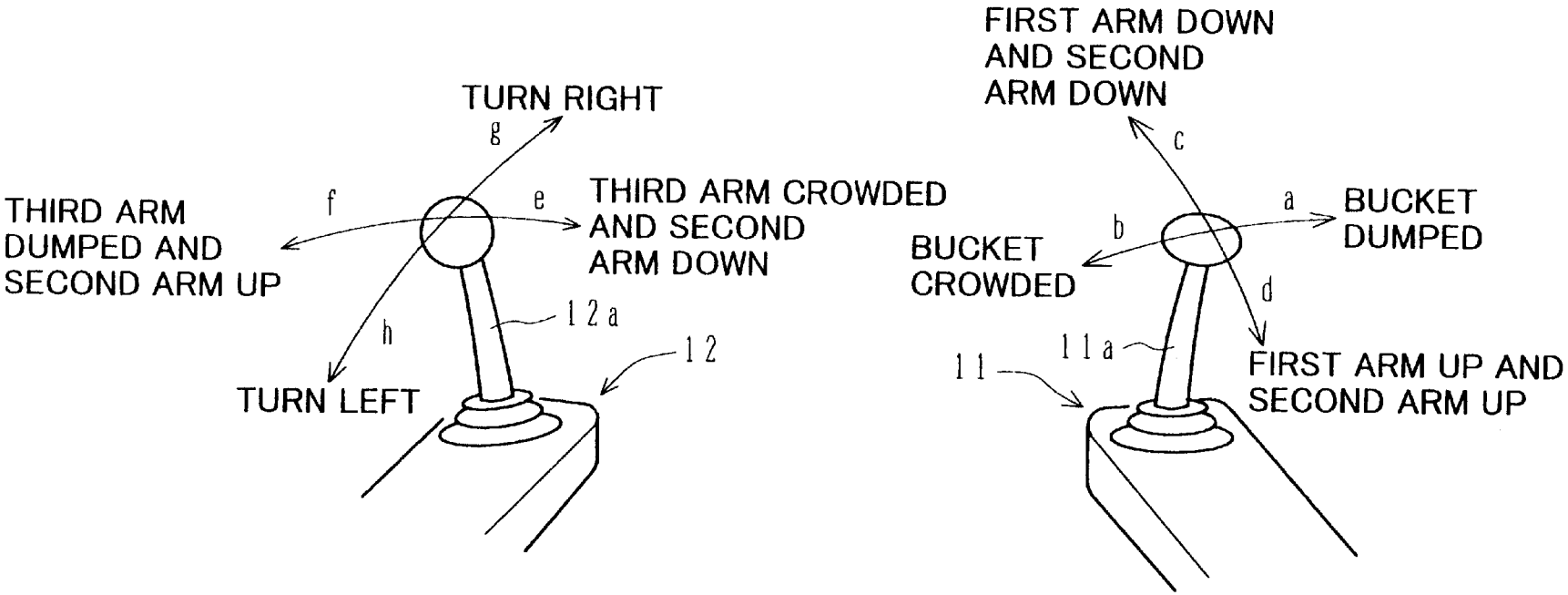
FIG. 3 is an illustration for explaining an operating manner of control lever units of the operation control system for the 3-articulation type excavator according to one embodiment of the present invention.

FIG. 3 shows details of an operating manner of the control lever units 11, 12.

In FIG. 3, the operation for the bucket and the turn is exactly the same as in the conventional excavator. More specifically, when the control lever 11*a* of the control lever unit 11 disposed on the right side is operated to the right (a), the bucket 6 is moved to the dumping side (unfolding side) at a speed depending on the input amount. Likewise, when the control lever 11*a* is operated to the left (b), the bucket 6 is moved to the crowding side (scooping side) at a speed depending on the input amount. The upper turning structure constituting the excavator body 13 is turned to the right or left at a speed depending on the input amount by operating the control lever 12*a* of the control lever unit 12, which is disposed on the left side, to the front (g) or rear (h).

Conventionally, when the control lever 11*a* of the control lever unit 11 is operated in the forward or rearward direction (c, d), only the first arm 3 is moved. In the present invention, when the control lever 11*a* of the control lever unit 11 is so operated, not only the first arm 3 is moved down or up at a speed depending on the input amount, but also the second arm 4 is moved at a speed depending on a value resulted from multiplying the input amount by a first arm assistive gain K1.

Further, conventionally, when the control lever 12*a* of the control lever unit 12 is operated in the leftward or rightward direction (f, e), only the third arm 5 is moved. In the present invention, when the control lever 12*a* of the control lever unit 12 is so operated, not only the third arm 5 is moved to dump or crowd at a speed depending on the input amount, but also the second arm 4 is moved at a speed depending on a value resulted from multiplying the input amount by a third arm assistive gain K3.

More specifically, a speed command value X1 for the first arm 3 is determined depending on the input amount from the control lever 11*a* in the direction c, d. Assuming that the side (d) corresponding to move-up of the first arm is positive, the side (c) corresponding to move-down of the first arm is negative, and a speed command value which is resulted upon the control lever being fully operated and corresponds to a rated speed of the first arm is 1, X1 is given by:

$$-1<X1<1$$

Also, a speed command value X3 for the first arm 5 is determined depending on the input amount from the control lever 12*a* in the direction e, f. Assuming that the side (f) corresponding to dumping of the third arm is positive, the side (e) corresponding to crowding of the third arm is negative, and a speed command value which is resulted upon the control lever being fully operated and corresponds to a rated speed of the third arm is 1, X3 is given by:

$$-1<X3<1$$

Here, assuming that the side corresponding to move-up of the second arm is positive, a speed command value X2 for the second arm 4 is given by:

$$X2=K1\times X1+K3\times X3$$

Figure 4:
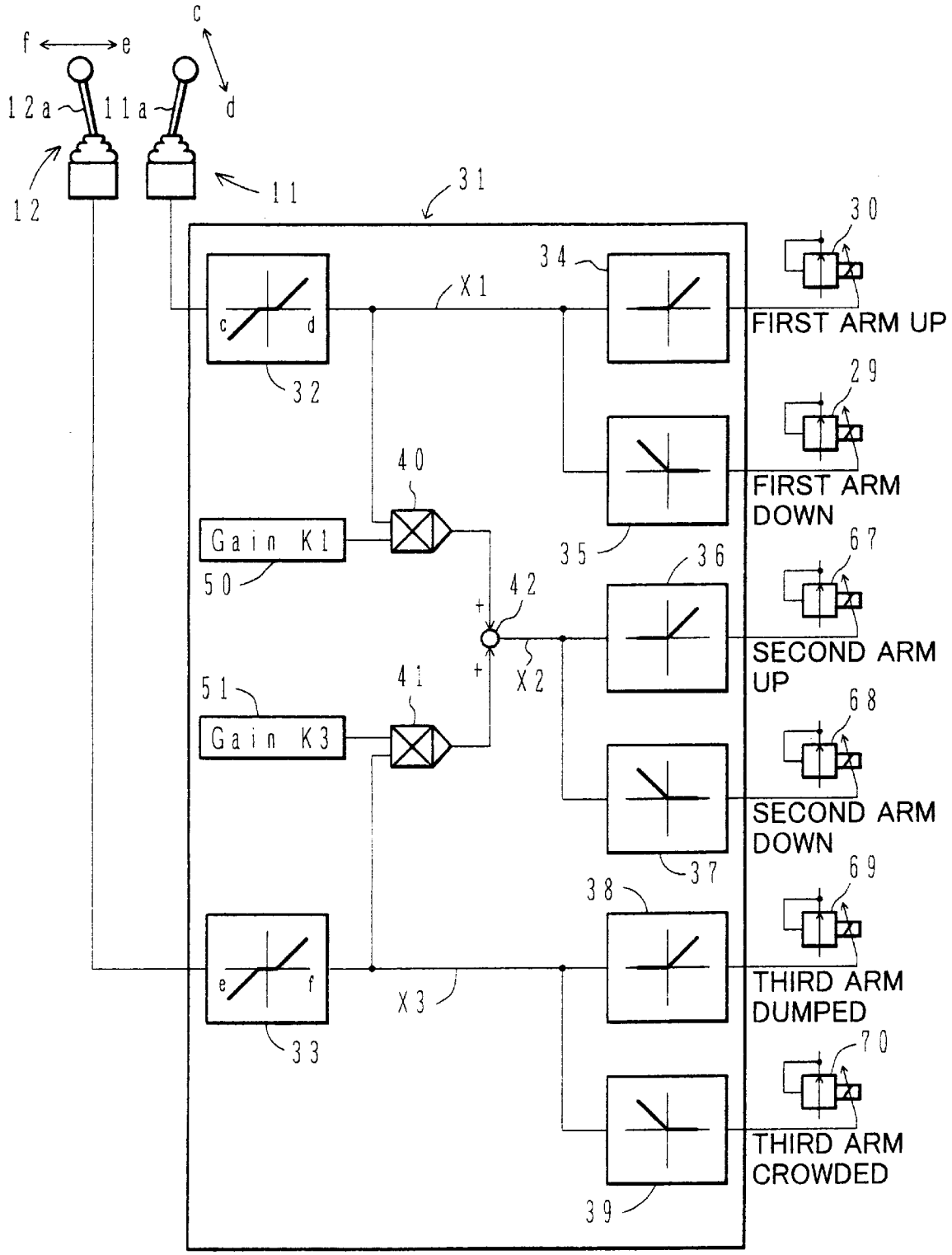
FIG. 4 is a block diagram showing functions of a controller of the operation control system for the 3-articulation type excavator according to one embodiment of the present invention.

FIG. 4 shows the above operation in the form of a block diagram illustrating functions of the controller 31.

In FIG. 4, the operation signal applied from the control lever unit 11 for the first arm 3 and the operation signal applied from the control lever unit 12 for the third arm 5 are introduced to speed command value functions 32, 33 provided in the controller 31, and are converted into the speed command values X1, X3 for the first and third arms, respectively. The speed command value functions 32, 33 mainly serve to provide dead zones in the vicinity of neutral points and make non-linear the relationships between the input amounts from the control levers 11*a*, 11*b* and the speed command values for actuators. Depending on cases, the speed command value functions 32, 33 may be omitted.

Based on the above-stated concept, the speed command value X2 for the second arm is provided as;

$$X2=K1\times X1+K3\times X3$$

by multipliers 40, 41 and an adder 42 using the speed command values X1, X3 for the first and third arms and the first and third arm assistive gains K1, K3 which are shown respectively in blocks 50, 51 and stored in the controller 31 beforehand.

Denoted by 34–39 are saturation functions. How the saturation functions 34, 35 take part in the operation of the first arm 3 will be described below.

The first arm speed command value X1 is represented in the controller 31 by one value which is positive on the move-up side and negative on the move-down side. On the other hand, in the practical hydraulic circuit, it is required to excite the proportional pressure reducing valve 30 when the first arm is moved up, and to excite the proportional pressure reducing valve 29 when the first arm is moved down. The saturation functions are used to make conversion necessary for so exciting the proportional pressure reducing valves. Specifically, when the first arm speed command value X1 is positive, the saturation function 34 allows the command value to be delivered as it is to the proportional pressure reducing valve 30, but the saturation function 35 prevents a signal from being delivered to the proportional pressure reducing valve 29 (i.e., allows only 0 to be delivered).

Also, when the first arm speed command value X1 is negative, the saturation function 35 allows the command value to be delivered to the proportional pressure reducing valve 29 while making the sign of the command value reversed from positive to negative, but keeping the magnitude of the command value the same. At this time, the saturation function 34 prevents a signal from being delivered to the proportional pressure reducing valve 30 (i.e., allows only 0 to be delivered).

The saturation functions 36, 37; 38, 39 operate likewise such that respective signals are delivered to proportional pressure reducing valves 67 or 68; 69 or 70 depending on whether the second and third arm speed command values X2, X3 are positive or negative. The proportional pressure reducing valves 67 or 68; 69 or 70 are ones disposed in the pilot lines 64*a*, 64*b*; 65*a*, 65*b* shown in FIG. 2, but not shown themselves in FIG. 2.

This embodiment thus constructed operates as follows. Let assume that K1=K2=0.5, for example, is set in the operation explained below.

When the control lever 11*a* is fully operated in the direction d with intent to move up the first arm 3, the first arm 3 is moved at the rated speed in the up-direction because of X1=1, and simultaneously the second arm 4 is also moved at a speed half the rated speed in the up-direction for assisting the movement of the first arm 3 because the command value for the second arm 4 is given by X2=0.5. When the control lever 11*a* is fully operated in the direction c with intent to move down the first arm 3, the second arm 5 is also moved at a speed half the rated speed in the down-direction for assisting the first arm which is moved down at the rated speed, because of X1=−1 and X2=−0.5.

Next, when the control lever 12*a* is fully operated in the direction f with intent to dump the third arm 5, the third arm 5 is moved at the rated speed in the dumping direction because of X3=1, and simultaneously the second arm 4 is also moved at a speed half the rated speed in the up-direction for assisting the movement of the second arm 4 because the command value for the second arm 4 is given by X2=0.5. When the control lever 12*a* is fully operated in the direction e with intent to crowd the third arm 5, the second arm 4 is also moved at a speed half the rated speed in the down-direction for assisting the third arm 5 which is crowded at the rated speed, because of X3=−1 and X2=−0.5.

Further, when the control lever 11*a* is fully operated in the direction d to move up the first arm 3 and at the same time the control lever 12*a* is fully operated in the direction f to dump the third arm 5, all the arms are moved at the rated speed in the direction of unfolding the articulations because of X1=1 and X3=1; hence X2=1.

When the control lever 11*a* is fully operated in the direction d to move up the first arm 3 and at the same time the control lever 12*a* is fully operated in the direction e to crowd the third arm 5, the second arm 4 is not moved because of X1=1 and X3=−1; hence X2=0. The reason is that because the first arm 3 is instructed to move in the direction of unfolding the articulation whereas the third arm 5 is instructed to move in the direction of folding the articulation, the respective movements of the second arm 4 tending to assist the movements of the first and third arms 3, 5 are canceled.

With this embodiment, as explained above, the three articulated members, including the second arm 4, of the 3-articulation type excavator can be operated by the same two control levers 11*a*, 12*a* as used in the conventional 2-articulation type excavator, without making the operator feel awkward. In addition, the 3-articulation type excavator can be operated continuously over a wide working area, which is an advantageous feature of 3-articulation type excavators, with the same operating feeling as obtained with conventional 2-articulation type excavators.

While the above description has been made as setting the assistive gains K1, K3 to 0.5, the assistive gains can be set to any desired values depending on circumstances of the work and preference of the operator. For example, if the assistive gains are set to larger values, the excavator can be operated more quickly in the wide working area. Conversely, if the assistive gains are set to smaller values, the excavator can be operated with a feeling closer to that of conventional excavators.

While the above embodiment has been described as setting the first arm assistive gain K1 equal to the third arm assistive gain K3, these assistive gains may have different values from each other depending on a situation in use of the excavator and preference of the operator. For example, if it is desired to move the third arm in a manner closer to that in conventional excavators, the third arm assistive gain K3 may be set to a smaller value. Alternatively, the third arm assistive gain K3 may be set to a larger value for the purpose opposite to the above.

Further, the first arm assistive gain K1 and the third arm assistive gain K3 may be set to variable values as explained below.

Figure 14:
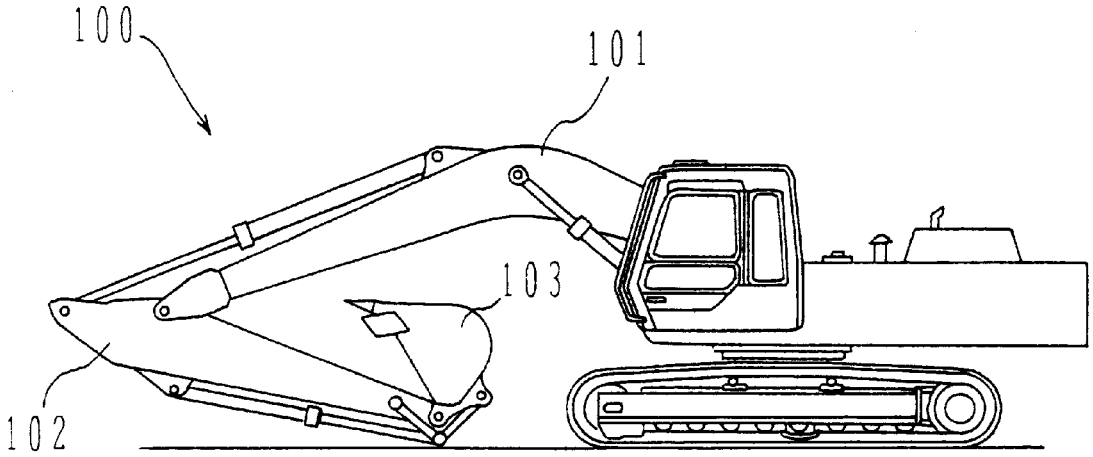
FIG. 14 is a view for explaining the structure of a conventional 2-articulation type excavator.
Figure 15:
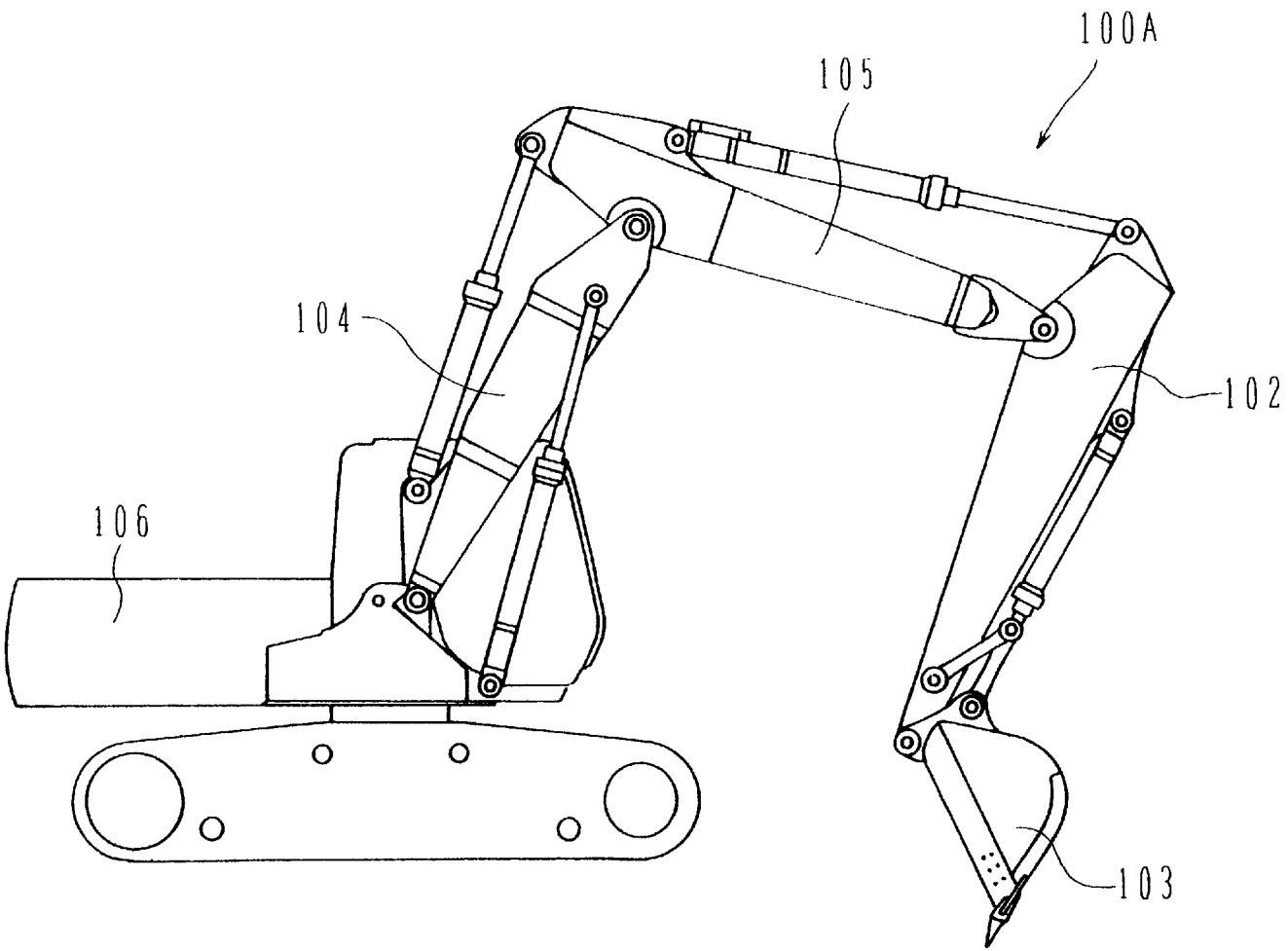
FIG. 15 is a view for explaining the structure of a two-piece boom type excavator as one example of conventional 3-articulation type excavators.
Figure 16:
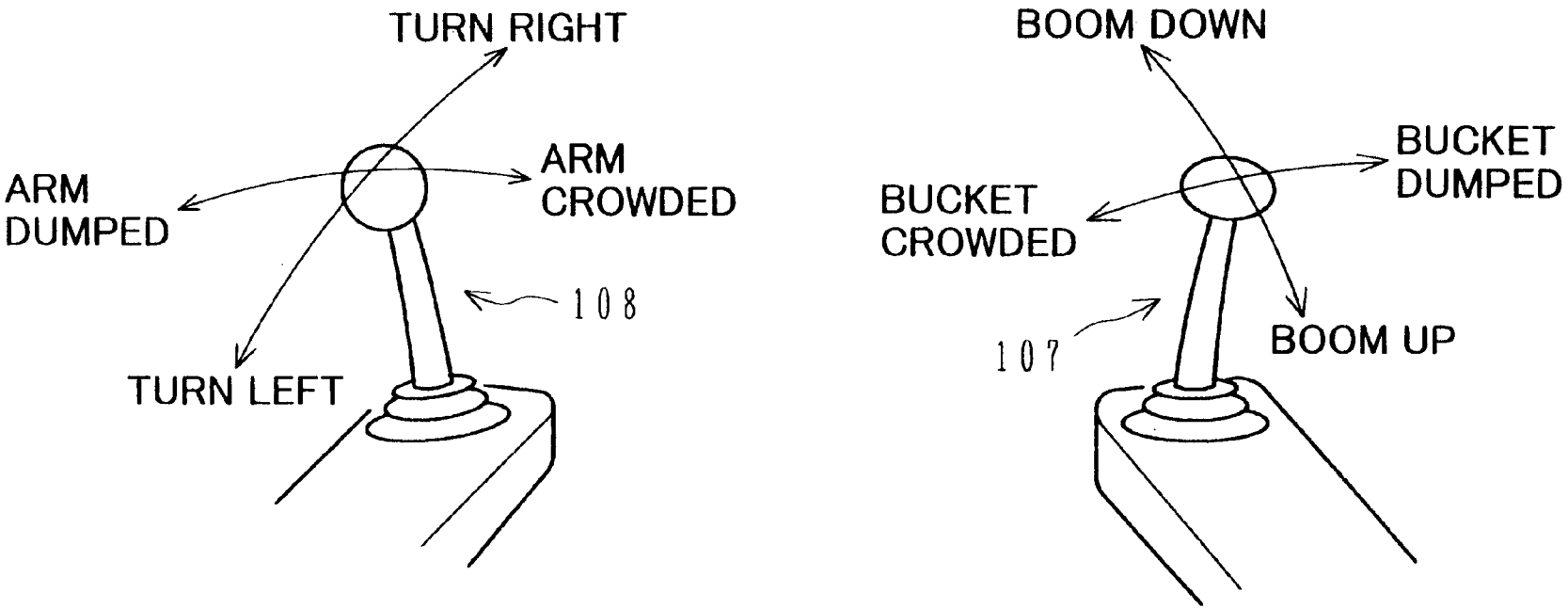
FIG. 16 is an illustration for explaining an operating system of the conventional 2-articulation type excavator.
Figure 17:
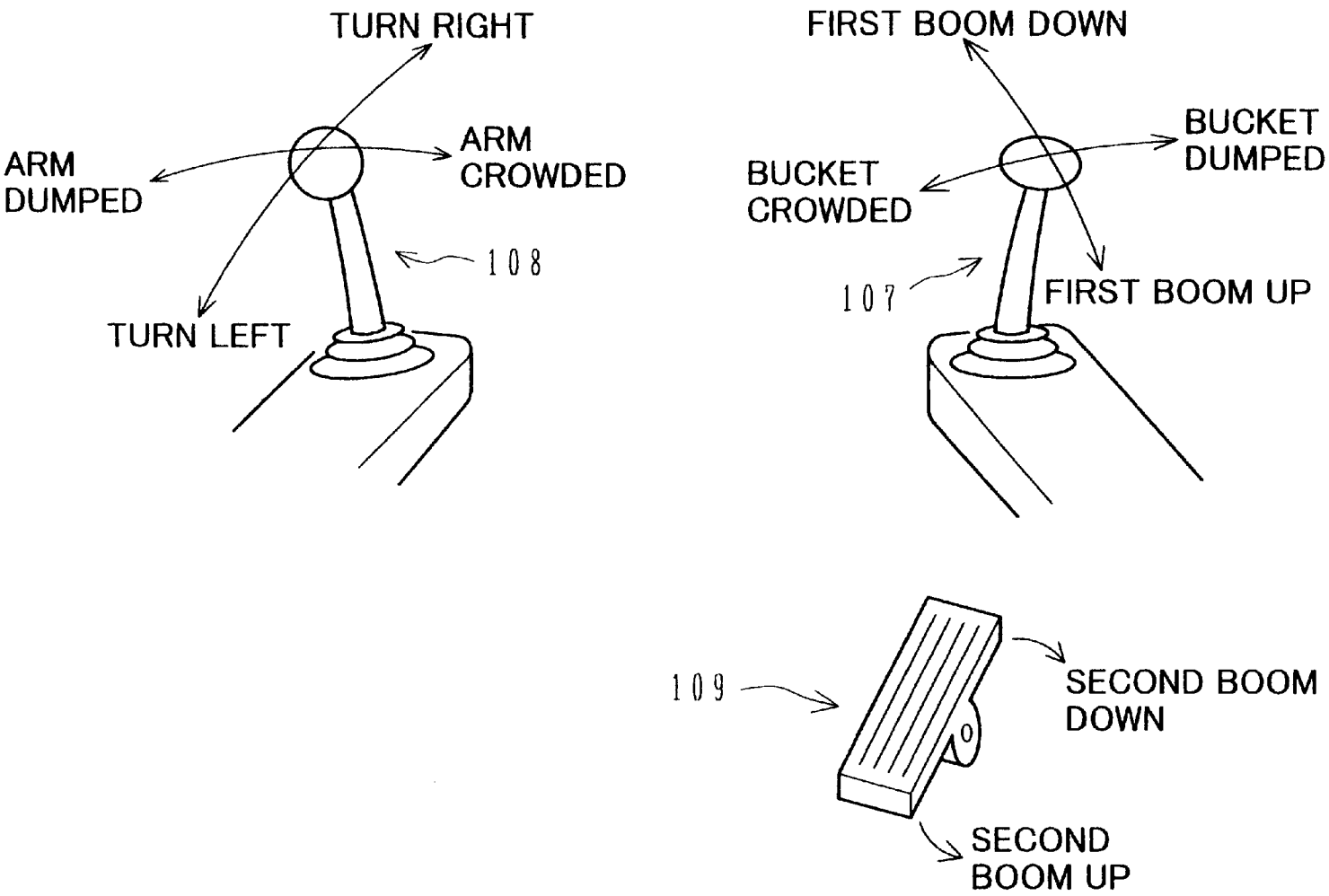
FIG. 17 is an illustration for explaining an operating manner of control lever units of the conventional two-piece boom type excavator.

In the 2-articulation type excavator shown in FIG. 14 which has been generally employed in the past, for the reason of the specific structure, the boom 101 is used in many cases when the operator intends to move the position of the bucket 103 vertically. Also, the arm 102 is used in many cases when the operator intends to move the position of the bucket 103 back and forth (i.e., in the direction to move toward/away from the body). As a method for making operators, who have been familiar with such an operating manner, feel less awkward, it is effective to change the assistive gains K1, K3 depending on the posture of the working front device.

Figure 5:
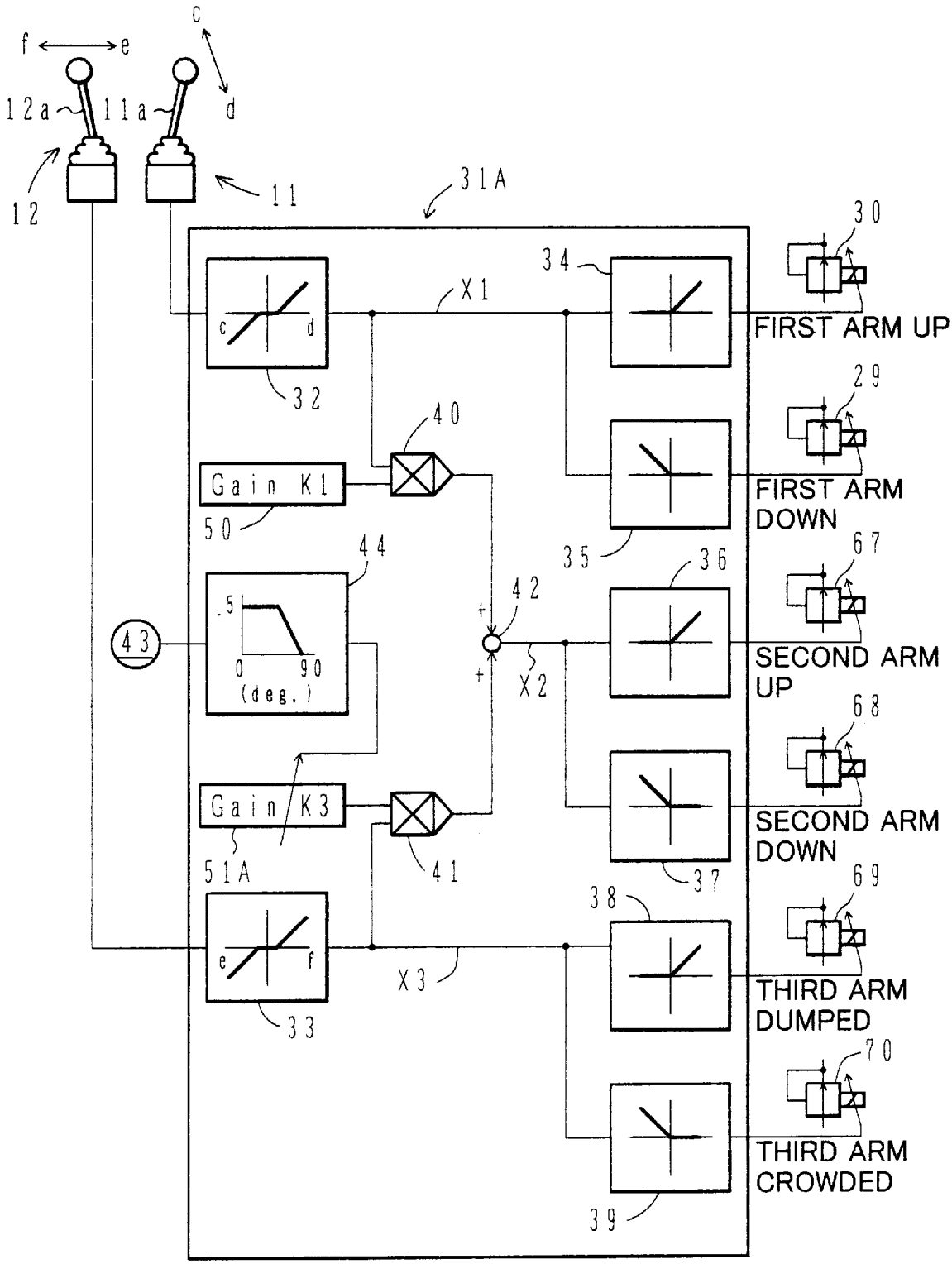
FIG. 5 is a block diagram similar to FIG. 4, showing another embodiment of the present invention for varying an assistive gain.

FIG. 5 shows an embodiment in which the assistive gain K3 is variable. A first arm angle sensor 43 (see FIG. 1) comprising a potentiometer is disposed at a pivotal point between the first arm 3 and the excavator body 13, and a signal from the first arm angle sensor 43 is introduced to a controller 31A (see FIG. 2). The third arm assistive gain K3 which is usually set to about 0.5, for example, is changed with a function 44 such that it is gradually reduced as the angle of the first arm 3 relative to the plane, on which the excavator body 13 rests, approaches 90 degrees. The resulting value is used as a value output from a block 51A.

With this embodiment thus constructed, as the first arm 3 comes closer to its vertical position, the second arm 4 is less moved upon the operation of the third arm 5. This aims to operate the third arm 5 in a similar manner as when the control lever of the arm 102 of the 2-articulation type excavator is operated, i.e., to operate the third arm 5 in such a way as reflecting the intent of the operator to move the bucket position back and forth. In other words, when the first arm 3 comes close to the vertical position, the second arm 4 acts to move the bucket 6 vertically contrary to the back-and-forth movement of the bucket 6 that is intended by the operator when operating the third arm 5. Therefore, the gain K3 is reduced to suppress the movement of the second arm 4 assisting to move the bucket 6 vertically, thereby keeping the operator from feeling awkward.

While in the above description the first arm angle sensor 43 is constituted by a potentiometer disposed at the pivotal point between the first arm 3 and the excavator body 13 to detect the angle of the first arm, the target angle of the first arm may be calculated from the geometrical relationship by providing a position sensor to detect the stroke of the first arm cylinder 7.

Figure 6:
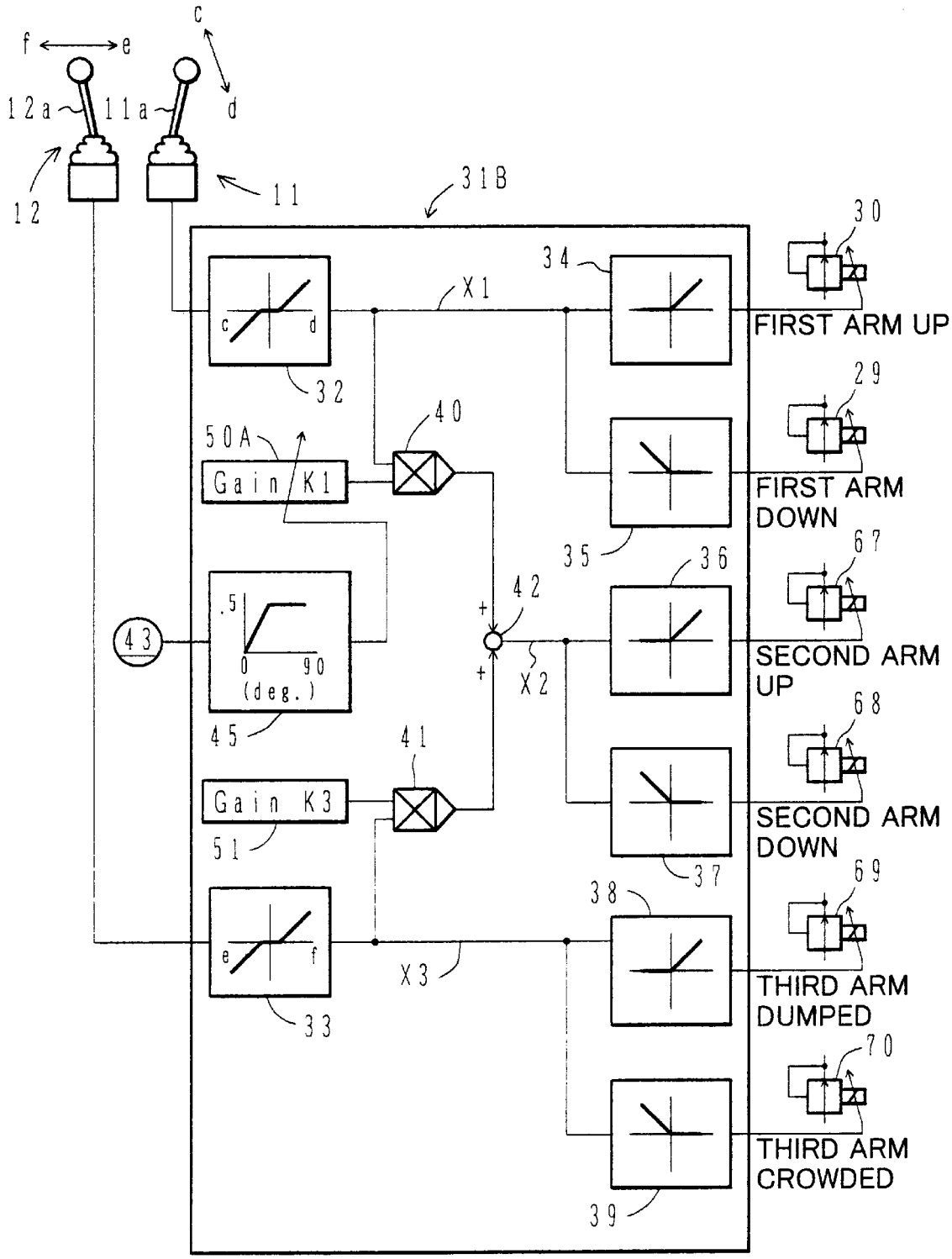
FIG. 6 is a block diagram similar to FIG. 4, showing still another embodiment of the present invention for varying the assistive gain.

FIG. 6 shows an embodiment in which the assistive gain K1 is variable. The first arm angle sensor 43 is disposed as with the embodiment of FIG. 5, and a signal from the first arm angle sensor 43 is introduced to a controller 31B (see FIG. 2). The first arm assistive gain K1 which is usually set to about 0.5, for example, is changed with a function 45 such that it is gradually reduced as the angle of the first arm 3 relative to the plane, on which the excavator body 13 rests, approaches 0 degree. The resulting value is used as a value output from a block 50A.

With this embodiment thus constructed, as the first arm 3 comes closer to its horizontal position, the second arm 4 is less moved upon the operation of the first arm 3. This aims to operate the first arm 3 in a similar manner as when the control lever of the boom 101 of the 2-articulation type excavator is operated, i.e., to operate the first arm 3 in such a way as reflecting the intent of the operator to move the bucket position vertically. In other words, when the first arm 3 comes close to the horizontal position, the second arm 4 acts to move the bucket 6 back and forth contrary to the vertical movement of the bucket 6 that is intended by the operator when operating the first arm 3. Therefore, the gain K1 is reduced to suppress the movement of the second arm 4 assisting to move the bucket 6 back and forth, thereby keeping the operator from feeling awkward.

Figure 7:
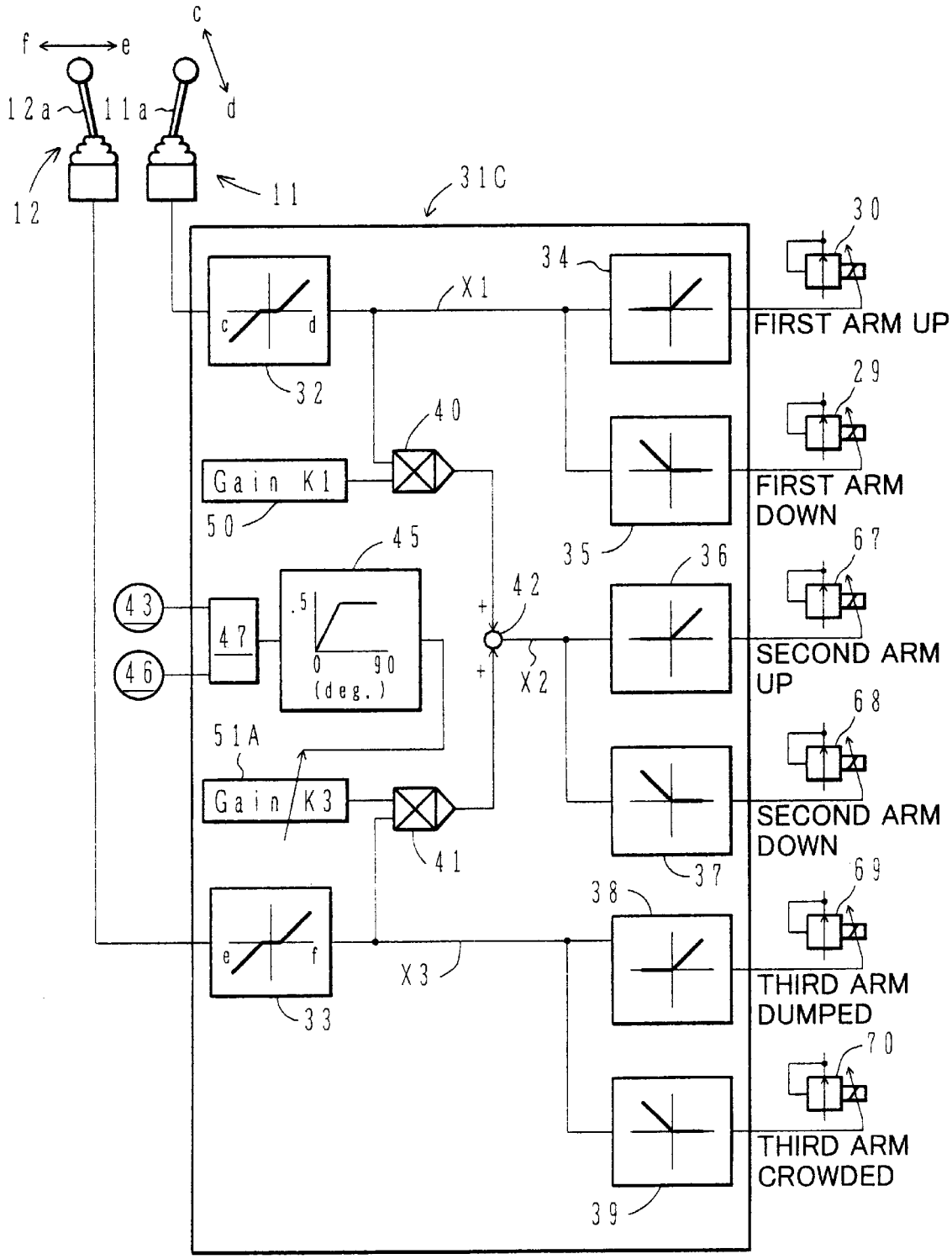
FIG. 7 is a block diagram similar to FIG. 4, showing still another embodiment of the present invention for varying the assistive gain.

FIG. 7 shows another embodiment in which the assistive gain K3 is variable. In addition to the first arm angle sensor 43 disposed as with the embodiment of FIG. 5, an angle sensor 46 comprising a potentiometer and detecting an angle of the second arm 4 relative to the first arm 3 is disposed at the pivotal point between the first arm 3 and the second arm 4 (see FIG. 1). Signals from these angle sensors are introduced to a controller 31C (see FIG. 2) where a second arm absolute angle calculating portion 47 calculates an absolute angle of the second arm 4 relative to the excavator body 13. The absolute angle of the second arm is introduced to a function 45. The third arm assistive gain K3 which is usually set to about 0.5, for example, is changed with the function 45 such that it is gradually reduced as the angle of the second arm 4 (second arm absolute angle) relative to the plane, on which the excavator body 13 rests, approaches 0 degree. The resulting value is used as a value output from the block 51A.

With this embodiment thus constructed, as the second arm 4 comes closer to its horizontal position, the second arm 4 is less moved upon the operation of the third arm 5. This aims to operate the third arm 5 in a similar manner as when the control lever of the arm 102 of the 2-articulation type excavator is operated, i.e., to operate the third arm 5 in such a way as reflecting the intent of the operator to move the bucket position back and forth. In other words, when the second arm 4 comes close to the horizontal position, the second arm 4 acts to move the bucket 6 vertically contrary to the back-and-forth movement of the bucket 6 that is intended by the operator when operating the third arm 5. Therefore, the gain K3 is reduced to suppress the movement of the second arm 4 assisting to move the bucket 6 vertically, thereby keeping the operator from feeling awkward.

While in the above description the second arm absolute angle is determined by calculation means based on the geometrical relationship by detecting the relative angle between the first arm 3 and the excavator body 13 and the relative angle between the second arm and the first arm, the angle of the second arm 4 relative to the ground surface may be directly detected by providing a tilt sensor on the second arm 4.

Figure 8:
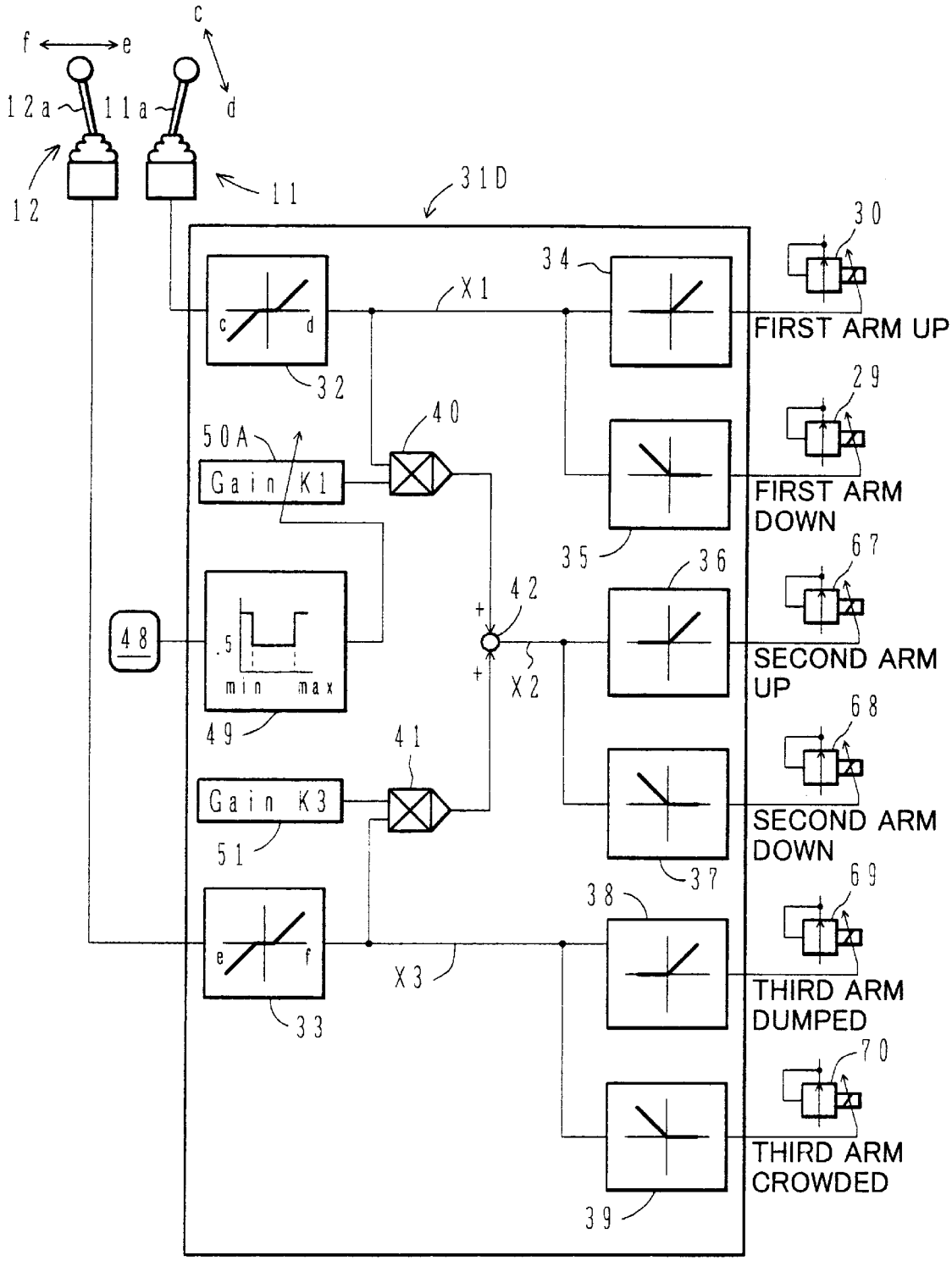
FIG. 8 is a block diagram similar to FIG. 4, showing still another embodiment of the present invention for varying the assistive gain.

FIG. 8 shows another embodiment in which the assistive gain K1 is variable. A sensor 48 for detecting a stroke of the first arm cylinder 7 is disposed (see FIG. 1), and a signal from the sensor 48 is introduced to a controller 31D (see FIG. 2). The first arm assistive gain K1 which is usually set to about 0.5, for example, is changed with a function 49 such that it is quickly increased as the first arm cylinder 7 comes close to the stroke end thereof on the longest or shortest side. The resulting value is used as a value output from the block 50A.

With this embodiment thus constructed, as the first arm cylinder 7 comes closer to the stroke end, the second arm 4 is caused to speed up quickly. When the first arm cylinder 7 reaches the stroke end and is abruptly stopped while the control lever 11*a* is being operated to move the first arm 3 at a speed corresponding to the command value X1 and the third arm 4 is moving at a speed resulted by multiplying the command value X1 by the first arm assistive gain K1, the movement of the bucket 6 is slowed down abruptly. The quick speed-up of the second arm 4 aims to relieve such an abrupt slow-down of the bucket 6 that is not intended by the operator. In other words, when the first arm cylinder 7 is stopped at the stroke end, the gain K1 is increased to speed up the second arm 4 assisting, thereby preventing the bucket 6 from being slowed down abruptly and hence keeping the operator from feeling awkward.

While in the above description the sensor 48 for detecting a stroke of the first arm cylinder 7 has been assumed to be a sensor for detecting the cylinder length, the stroke of the first arm cylinder 7 may be calculated based on the geometrical relationship by providing the potentiometer 43 at the pivotal point between the first arm 3 and the excavator body 13, as shown in FIG. 1, and detecting the angle of the first arm at the current time.

Further, a limit switch for detecting only the stroke end of the first arm cylinder 7 may be provided to increase the first assistive gain upon the limit switch being turned on.

Additionally, the above embodiment of FIG. 8 has been explained in connection with the case where the gain K1 is increased to speed up the second arm 4 when the first arm cylinder 7 comes close to or reach the stroke end. As an alternative, the abrupt slow-down of the bucket 6 may be prevented by a similar sensor 49 for detecting a stroke of the second arm cylinder 9 (see FIG. 1) and increasing the gain K3 when the third arm cylinder 9 comes close to or reach the stroke end, thereby speeding up the second arm 4.

Figure 9:
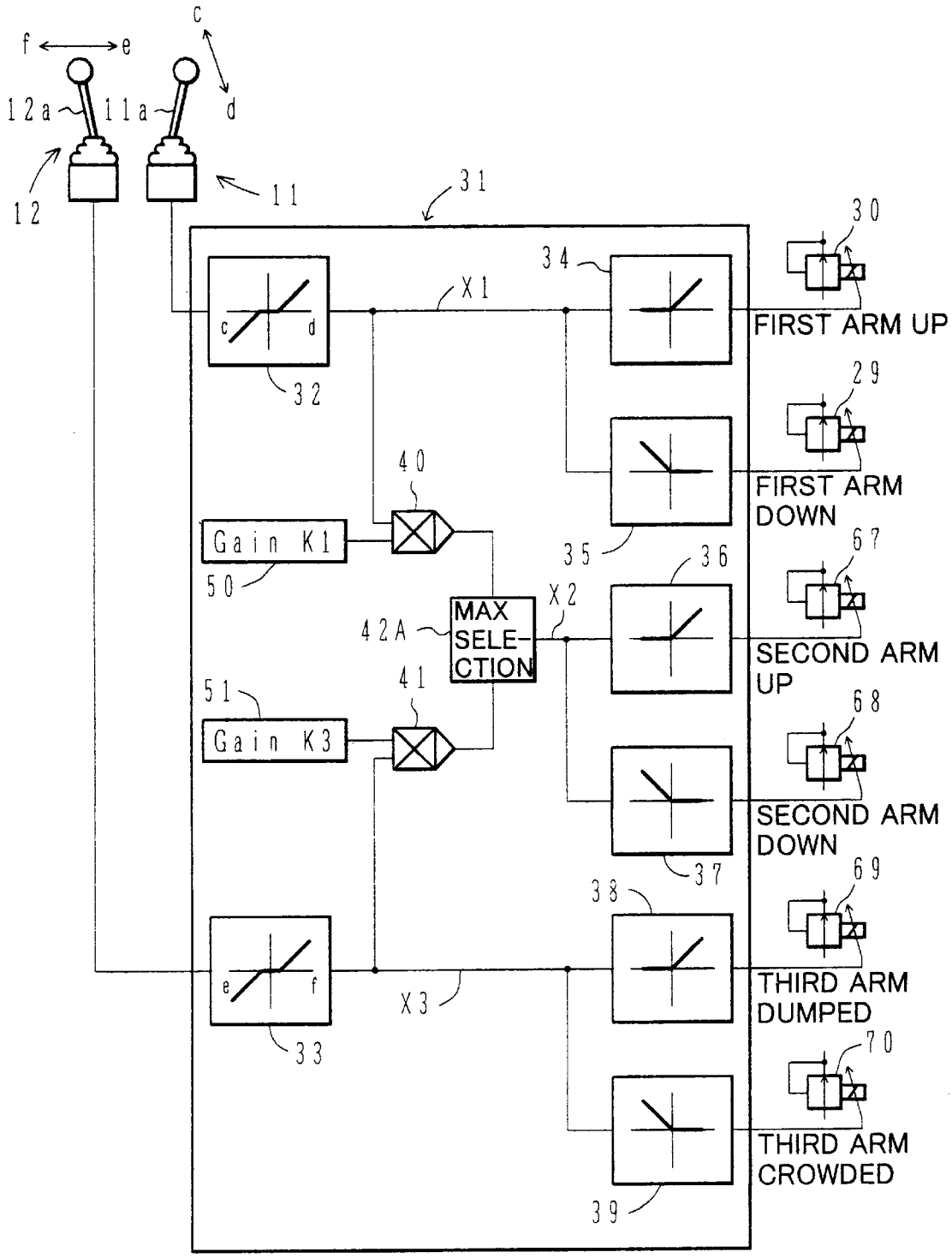
FIG. 9 is a block diagram similar to FIG. 4, showing another embodiment of the present invention using a maximum value selector instead of an adder.
Figure 10:
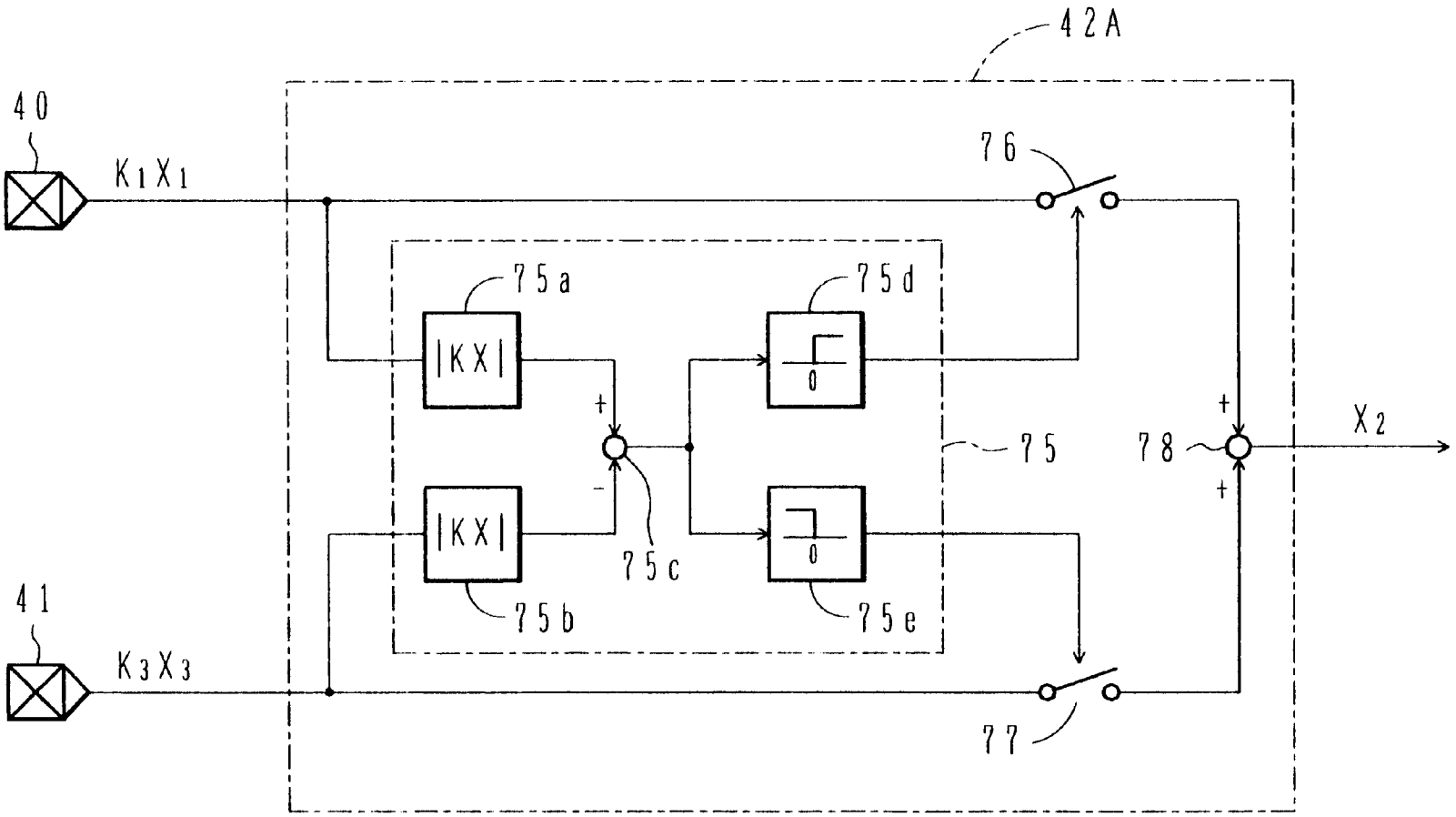
FIG. 10 is a block diagram showing details of the maximum value selector shown in FIG. 9.

FIGS. 9 and 10 show an embodiment in which the adder 42 is not used to calculate the command value X2 for the second arm 4 from the value resulted by multiplying the command value X1 by the assistive gain K1 and the value resulted by multiplying the command value X3 by the assistive gain K3.

Outputs of the multipliers 40, 41 are applied to a maximum value selector 42A. The maximum value selector 42A comprises, as shown in FIG. 10, a switch changing-over portion 75, switches 76, 77, and an adder 78. The switch changing-over portion 75 is made up of absolute value calculators 75*a,* 75*b,* a subtractor 75*c,* and changing-over signal calculators 75*d,* 75*e.* Values K1X1, K3X3 calculated by the multipliers 40, 41 are introduced respectively to the calculators 75*a,* 75*b* which determine absolute values of |K1X1| and |K3X3|. The subtractor 75*c* calculates ΔKX=|K1K1|−|K3X3|. When ΔKX is 0 or positive, an ON-signal is applied from the calculator 75*d* to the switch 76, and when ΔKX is negative, an ON-signal is applied from the calculator 75*e* to the switch 77. As a result, in the case of |K1X1|≧|K3X3|, the speed command value X2 for the second arm is provided by X2=K1X1 through the switch 76 and the adder 78, and in the case of |K1X1|<|K3X3|, the speed command value X2 for the second arm is provided by X2=K3X3 through the switch 77 and the adder 78.

By thus determining a maximum value of |K1X1| and |K3X3| as the speed command value for the second arm, the working front device can be moved substantially in the same manner as obtained when calculating the sum of K1X1 and K3X3, resulting in similar advantages to those in the first embodiment.

Figure 11:
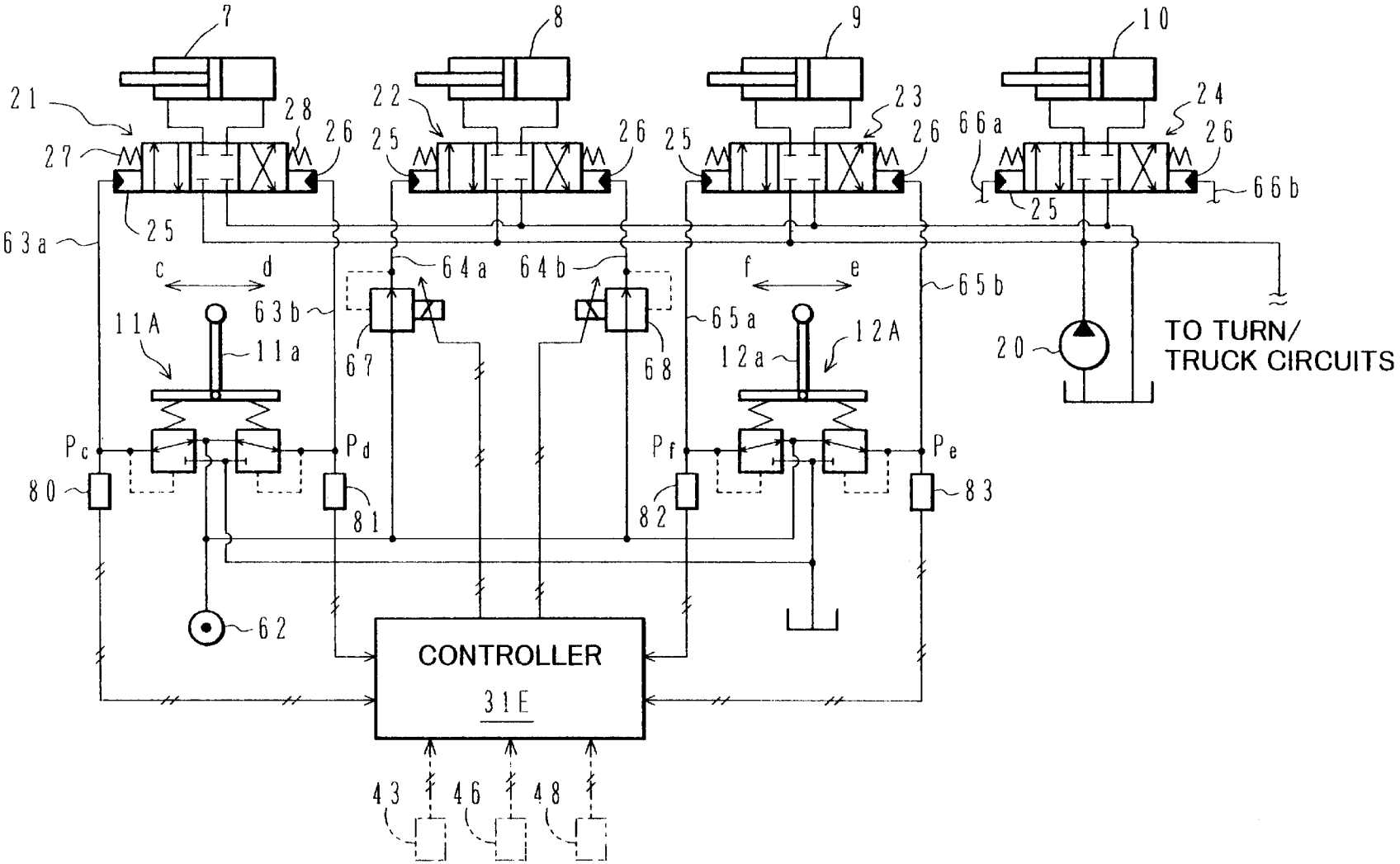
FIG. 11 is a diagram similar to FIG. 2, showing an embodiment in which the present invention is applied to an excavator having control lever units of the hydraulic pilot type.
Figure 12:
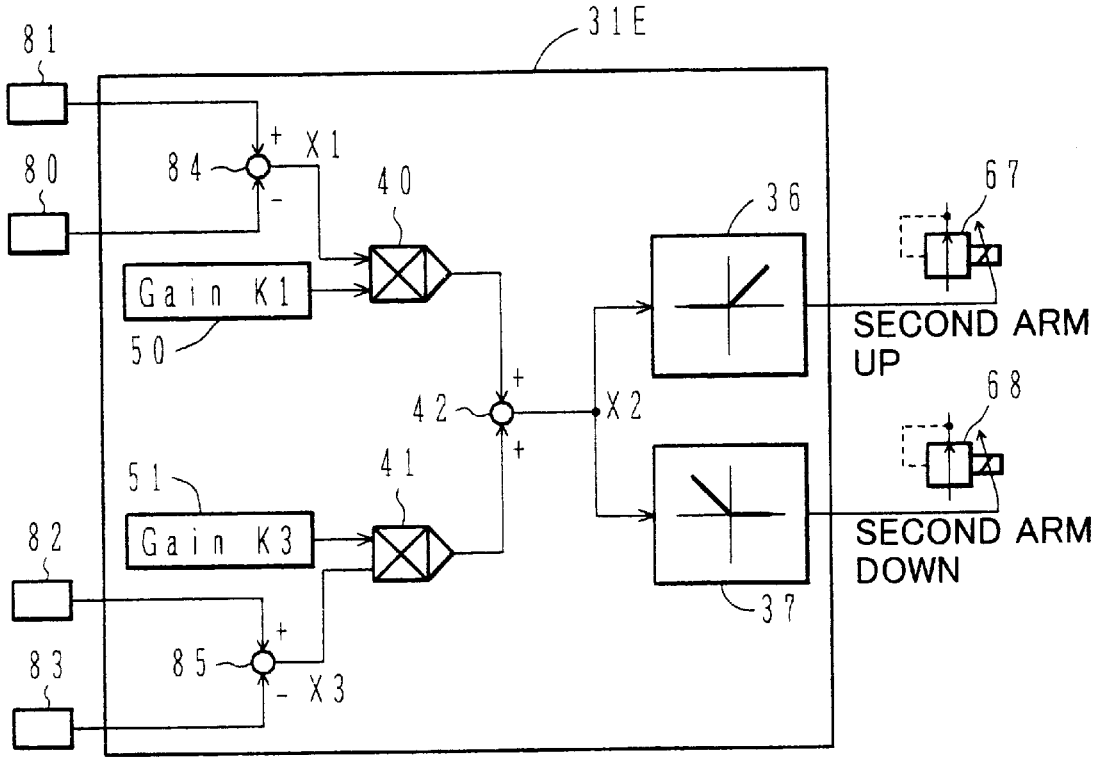
FIG. 12 is a block diagram similar to FIG. 4, showing functions of a controller shown in FIG. 11.

FIGS. 11 and 12 show an embodiment in which the present invention is applied to an excavator having control lever units of the hydraulic pilot type. In these drawings, equivalent members or functions to those shown in FIGS. 2 to 4 are denoted by the same reference numerals.

In FIG. 11, denoted by 11A, 11B are control lever units of the hydraulic pilot type outputting pilot pressures Pd, Pd; Pf, Pe. The pilot pressures Pc, Pc; Pf, Pe output from the control lever units 11A, 11B are introduced to pilot pressure chambers 25, 26 of flow control valves 21, 23 through pilot lines 63*a* or 63*b;* 65*a* or 65*b,* respectively, thereby shifting the flow control valves 21, 23. Similar control lever units (not shown) of the hydraulic pilot type are disposed in pilot lines 66*a,* 66*b* associated with a flow control valve 24. Such proportional pressure reducing valves as used in the first embodiment are not disposed in the pilot lines 63*a*, 63*b*; 65*a,* 65*b,* and proportional pressure reducing valves 67, 68 are disposed only in the pilot lines 64*a*, 64*b* for the second arm 4.

The control lever units 11A, 11B are operated in the same manner as in the first embodiment shown in FIG. 3. When a control lever 11*a* is operated in the direction c, the first arm is moved down and the second arm is also moved down, while when it is operated in the direction d, the first arm is moved up and the second arm is also moved up. When a control lever 12*a* is operated in the direction f, the third arm is dumped and the second arm is moved up, while when it is operated in the direction e, the third arm is crowded and the second arm is moved down.

Pressure sensors 80, 81, 82, 83 are connected to the pilot lines 63*a*, 63*b;* 65*a,* 65*b,* respectively, and detection signals from these pressure sensors are input to a controller 31E.

Processing functions of the controller 31E are shown in FIG. 12. The detection signals from the pressure sensors 80, 81; 82, 83 are introduced respectively to multipliers 40, 41 through subtractors 84, 85. The subtractors 84, 85 serve to calculate, from the detection signals of the pressure sensors 80, 81; 82, 83, command values which are equivalent to the first arm speed command value X1 and the third arm speed command value X3 in the first embodiment. More specifically, the pilot pressure Pc on the first arm down-side (c) detected by the pressure sensor 80 is taken in as a negative value by the subtractor 84, and the pilot pressure Pd on the first arm up-side (d) detected by the pressure sensor 81 is taken in as a positive value by the subtractor 84, thereby providing the speed command value X1 on condition that the move-up direction of the first arm is positive and the move-down direction thereof is negative. Also, the pilot pressure Pf on the third arm dumping-side (f) detected by the pressure sensor 82 is taken in as a positive value by the subtractor 85, and the pilot pressure Pe on the third arm crowding-side (e) detected by the pressure sensor 83 is taken in as a negative value by the subtractor 85, thereby providing the speed command value X3 on condition that the dumping direction of the third arm is positive and the crowding direction thereof is negative.

Figure 13:
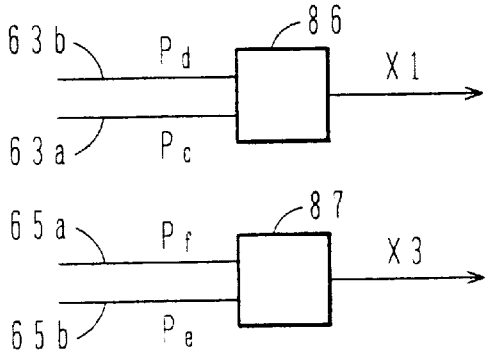
FIG. 13 is a block diagram showing an embodiment in which a differential pressure gauge is used instead of a pressure gauge.

Instead of the pressure sensors 80, 81; 82, 83, differential pressure sensors 86, 87 shown in FIG. 13 may be may be used. In this case, detection signals of the differential pressure sensors 86, 87 can be directly used as the first arm speed command value X1 and the third arm speed command value X3, respectively.

The process subsequent to the multipliers 40, 41 is the same as in the first embodiment shown in FIG. 4. More specifically, the speed command value X2 for the second arm is provided as;

$$X2=K1\times X1+K3\times X3$$

by the multipliers 40, 41 and an adder 42 using the speed command values X1, X3 for the first and third arms and the first and third arm assistive gains K1, K3 which are shown respectively in blocks 50, 51 and stored in the controller 31E beforehand.

When the second arm speed command value X2 is positive, a saturation function 36 allows the command value to be delivered as it is to a proportional pressure reducing valve 67, but a saturation function 37 prevents a signal from being delivered to a proportional pressure reducing valve 68 (i.e., allows only 0 to be delivered). When the second arm speed command value X2 is negative, the saturation function 37 allows the command value to be delivered to the proportional pressure reducing valve 68 while making the sign of the command value reversed from positive to negative, but keeping the magnitude of the command value the same. At this time, the saturation function 36 prevents a signal from being delivered to the proportional pressure reducing valve 67 (i.e., allows only 0 to be delivered).

This embodiment thus constructed operates in the same manner as the first embodiment except that the flow control valve 21 for the first arm 3 and the flow control valve 23 for the third arm 5 are directly driven by the pilot pressures output from the control lever units 11A, 12A of the hydraulic pilot type. With this embodiment, therefore, it is also possible to operate the three articulated members, including the second arm 4, of the 3-articulation type excavator by the same two control levers 11*a*, 12*a* as used in the conventional 2-articulation type excavator, without making the operator feel awkward. In addition, the 3-articulation type excavator can be operated continuously over a wide working area, which is an advantageous feature of 3-articulation type excavators, with the same operating feeling as obtained with conventional 2-articulation type excavators.

Industrial Applicability

According to the present invention, three articulated members, including a second arm, of a 3-articulation type excavator can be operated by the same two control levers as used in a conventional 2-articulation type excavator, without making the operator feel awkward. Moreover, the 3-articulation type excavator can be operated continuously over a wide working area, which is an advantageous feature of 3-articulation type excavators, with the same operating feeling as obtained with conventional 2-articulation type excavators.

We claim:

1. An operation control system for a 3-articulation type excavator, said operation control system being installed in a 3-articulation type excavator (1) comprising an excavator body (13), a first arm (3) rotatably attached to said excavator body, a second arm (4) rotatably attached to said first arm, a third arm (5) rotatably attached to said second arm, a digging bucket (6) rotatably attached to said third arm, and a hydraulic drive circuit (60) including a first arm cylinder (7) for driving said first arm, a second arm cylinder (8) for driving said second arm, a third arm cylinder (9) for driving said third arm, and a bucket cylinder (10) for driving said digging bucket, said operation control system comprising first arm operating means (11) including a first control lever (11*a*) for commanding a speed of said first arm (3) depending on operation of said first control lever (11*a*), and third arm operating means (12) including a second control lever (12*a*) for commanding a speed of said third arm (5) depending on operation of said second control lever (12*a*), said first arm cylinder (7) and said third arm cylinder (9) of said hydraulic drive circuit (60) being driven in accordance with respective operation signals from said first arm operating means (11) and said third arm operating means (12), wherein:

said operation control system further comprises second arm commanding means (32, 33, 40, 41, 42, 50, 51) for producing a speed command value (X2) for said second arm (4) that is calculated from a first value resulted by multiplying a speed command value (X1) indicated by the operation signal from said first arm operating means (11) by a first arm assistive gain (K1) and a second value resulted by multiplying a speed command value (X3) indicated by the operation signal from said third arm operating means (12) by a third arm assistive gain (K3), and output means (36, 37) for converting the speed command value (X2) for said second arm (4) into a signal, said second arm cylinder (8) of said hydraulic drive circuit (60) being driven in accordance with the signal from said output means.

2. An operation control system for a 3-articulation type excavator according to claim 1, wherein said second arm commanding means (32, 33, 40, 41, 42, 50, 51) includes adding means (42) for determining, as a calculated value giving the speed command value (X2) for said second arm (4), the sum of said first value and said second value.

3. An operation control system for a 3-articulation type excavator according to claim 1, wherein said second arm commanding means (32, 33, 40, 41, 42A, 50, 51) includes selecting means (42A) for determining, as a calculated value giving the speed command value (X2) for said second arm (4), a maximum value between absolute values of said first value and said second value.

4. An operation control system for a 3-articulation type excavator according to claim 1, further comprising means (43) for detecting a rotational angle of said first arm (3) relative to the plane on which said excavator body (13) rests, wherein said second arm commanding means (32, 33, 40, 41, 42, 44, 50, 51A) receives a signal from said detecting means (43) and reduces the third arm assistive gain (K3) when said first arm (3) comes close to a vertical position relative to the plane on which said excavator body (13) rests.

5. An operation control system for a 3-articulation type excavator according to claim 1, further comprising means (43) for detecting a rotational angle of said first arm (3) relative to the plane on which said excavator body (13) rests, wherein said second arm commanding means (32, 33, 40, 41, 42, 45, 50A, 51) receives a signal from said detecting means (43) and reduces the first arm assistive gain (K1) when said first arm (3) comes close to a horizontal position relative to the plane on which said excavator body (13) rests.

6. An operation control system for a 3-articulation type excavator according to claim 1, further comprising means (43, 46, 47) for detecting a rotational angle of said second arm (4) relative to the plane on which said excavator body (13) rests, wherein said second arm commanding means (32, 33, 40, 41, 42, 45, 50, 51A) receives a signal from said detecting means (43, 46, 47) and reduces the third arm assistive gain (K3) when said second arm (4) comes close to a horizontal position relative to the plane on which said excavator body (13) rests.

7. An operation control system for a 3-articulation type excavator according to claim 1, further comprising means (48) for detecting a stroke of said first arm cylinder (7), wherein said second arm commanding means (32, 33, 40, 41, 42, 49, 50A, 51) receives a signal from said detecting means (48) and increases the first arm assistive gain (K1) when said first arm cylinder (7) reaches or comes close to the stroke end thereof.

8. An operation control system for a 3-articulation type excavator according to claim 1, further comprising means (49) for detecting a stroke of said third arm cylinder (9), wherein said second arm commanding means (32, 33, 40, 41, 42, 50, 51) receives a signal from said detecting means (49) and increases the third arm assistive gain (K3) when said third arm cylinder (9) reaches or comes close to the stroke end thereof.

9. An operation control system for a 3-articulation type excavator (1) according to claim 1, wherein said hydraulic drive circuit includes a first flow control valve (21), a second flow control valve (22) and a third flow control valve (23) for controlling respective flow rates of a hydraulic fluid supplied to said first arm cylinder (7), said second arm cylinder (8) and said third arm cylinder (9), and wherein:

said operation control system further comprises a pilot circuit (61) for introducing respective pilot pressures to said first, second and third flow control valves (21, 22, 23) for operation thereof, said pilot circuit including a pair of pilot lines (64*a*, 64*b*) for introducing the pilot pressures to said second flow control valve (22) for operation thereof, and a pair of proportional pressure reducing valves (67, 68) disposed in said pair of pilot lines and operated by output signals from said output means (36, 37), respectively.

10. An operation control system for a 3-articulation type excavator (1) according to claim 1, wherein said first arm operating means (11) and said third arm operating means (12) are of the electric lever type outputting electrical signals as said operation signals, wherein:

said second arm commanding means (32, 33, 40, 41, 42, 50, 51) receives the electrical signals from said first arm operating means (11) and said third arm operating means (12), and determines said speed command values (X1, X3) from the received electrical signals.

11. An operation control system for a 3-articulation type excavator (1) according to claim 1, wherein said first arm operating means (11A) and said third arm operating means (12A) are of the hydraulic pilot type outputting pilot pressures as said operation signals, wherein:

said operation control system further comprises means (80, 81, 82, 83; 86, 87) for detecting the respective pilot pressures from said first arm operating means (11A) and said third arm operating means (12A), and said second arm commanding means (40, 41, 42, 50, 51, 84, 85) receives signals from said detecting means (80, 81, 82, 83; 86, 87) and determines said speed command values (X1, X3) from the received signals.

* * * * *